United States Patent [19]

Everett

[11] Patent Number: 4,541,675

[45] Date of Patent: Sep. 17, 1985

[54] DISPLAY CANOPY

[75] Inventor: Lynn E. Everett, New Philadelphia, Ohio

[73] Assignee: Tusco Manufacturing Co., Gnadenhutten, Ohio

[21] Appl. No.: 510,628

[22] Filed: Jul. 5, 1983

Related U.S. Application Data

[63] Continuation-in-part of Ser. No. 285,542, Jul. 21, 1981, abandoned.

[51] Int. Cl.[4] ..... A47B 45/00

[52] U.S. Cl. ..... 312/257 R; 211/175; 211/189; 211/190

[58] Field of Search ..... 108/23; 312/257 R, 3; 211/190, 175, 189

[56] References Cited

U.S. PATENT DOCUMENTS

| | | | |
|---|---|---|---|
| 1,398,237 | 11/1921 | Michaels | 312/312 |
| 3,034,844 | 5/1962 | Anderson et al. | 312/257 SK |
| 3,393,031 | 7/1968 | Morrill | 312/257 R |
| 4,116,563 | 9/1978 | Kaufman | 108/23 |
| 4,148,533 | 4/1979 | Bustos et al. | 108/23 |
| 4,178,844 | 12/1979 | Ward et al. | 108/137 X |
| 4,225,068 | 9/1980 | Ingram | 211/190 X |

FOREIGN PATENT DOCUMENTS

| | | | |
|---|---|---|---|
| 512951 | 5/1955 | Canada | 312/257 R |

*Primary Examiner*—William E. Lyddane
*Assistant Examiner*—Joseph Falk
*Attorney, Agent, or Firm*—Fraser & Clemens

[57] ABSTRACT

A canopy structure adapted to be disposed over a conventional display gondola and having a universal mounting device attachable to the top marginal edge of the gondola. The canopy includes a header assembly having adjustable panels, a rear panel and a front sign panel. The rear edge of the header is attached to the mounting device and the opposite edge is supported by posts extending upwardly from the bottom shelf of the gondola.

10 Claims, 7 Drawing Figures

DISPLAY CANOPY

CROSS-REFERENCE TO RELATED APPLICATION

This application is a continuation-in-part of co-pending application Ser. No. 285,542, filed July 21, 1981 now abandoned.

BACKGROUND OF THE INVENTION

1. Field of the Invention

This invention generally relates to canopies for display gondolas and, more particularly, to canopies including a universal mounting strip whereby a standardized canopy can be easily mounted on a variety of different size display gondolas.

2. Description of the Prior Art

Display of products for sale is a paramount problem with retailers, business and commercial establishments. The ever-attendant suppliers of merchandising systems have presented to the market-place a variety of display systems to attract and entice consumers. Many products are sold in mass merchandising outlets, food stores and the like and use specially designed display racks and/or gondolas with and without headers or canopies.

Many of the display systems available in the present market-place typically are of the gondola type which includes a perforated, vertical back panel or pegboard for displaying products. Such gondolas are manufactured by a multitude of companies in a variety of sizes. Thus it is desirable to produce a standardized canopy which has a rigid, inherently strong structure and is easy and economical to install as well as being rugged in use.

SUMMARY OF THE INVENTION

Specifically, the invention is directed to means for mounting the canopy on the top marginal edge of the vertical back panel of a gondola. The means consists of a sheet metal mounting strip generally L-shaped in cross-section wherein one of the flange portions is adapted to be secured to the top marginal edge of the back panel by mounting screws or double face tape. The other flange portion is provided with means such as two pairs of spaced outwardly extending threaded studs or telescoping slide members for securing a header or other elements supporting the header thereto. The mounting strip is adapted to be mounted on the top marginal edge of the back panel either in an overlapping manner wherein the securing means extend outwardly from a position overlapping the back panel or, alternately, the mounting strip may be positioned such that the securing means extend outwardly from a position above the top marginal edge of the back panel. Manifestly, the mounting strip may be used interchangeably to position a canopy in two different vertical dispositions. Further, the depth of the canopy is adjustable for accommodating gondola shelves of different depths.

BRIEF DESCRIPTION OF THE DRAWINGS

The above as well as other objects of the invention will become readily apparent to one skilled in the art from reading the following detailed description of a preferred embodiment of the invention when considered in the light of the accompanying drawings in which.

DETAILED DESCRIPTION OF THE PREFERRED EMBODIMENT

Figure 1:
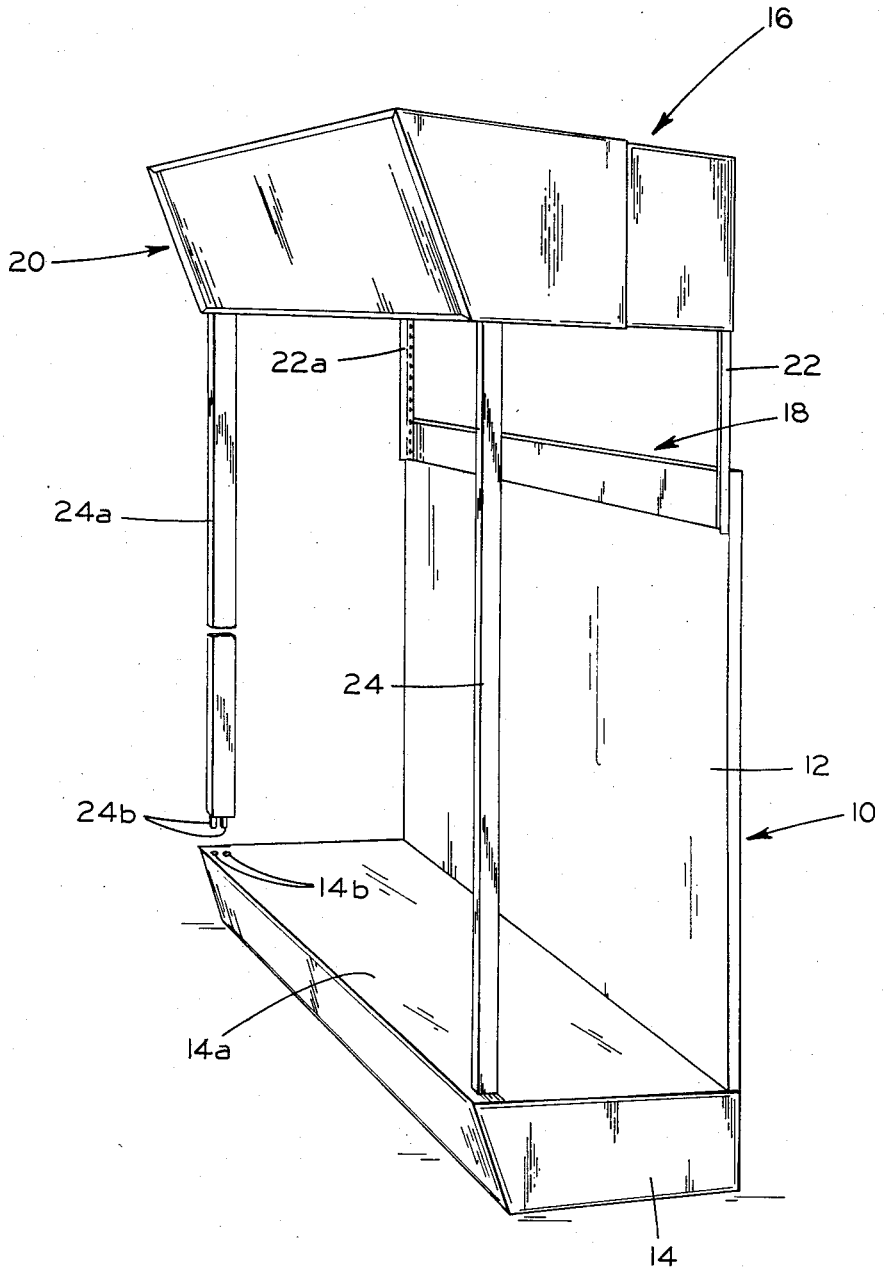
FIG. 1 is a perspective view of a single display gondola incorporating a canopy constructed in accordance with the invention.

Referring to the drawings wherein like reference numerals designate similar parts throughout, there is illustrated a typical gondola 10 including a back panel 12 extending vertically upwardly from the rear side of a bottom shelf 14.

Briefly, as illustrated in FIG. 1, a canopy 16 is adapted to be mounted on the top marginal edge of the back panel 12 by a universal mounting means 18. In addition to the mounting means 18, the canopy 16 generally includes a header assembly 20 supported by a pair of rear vertical mounting studs 22 and **22*a* and a pair of front posts 24 and 24*a* extending between the header assembly 20 and the top surface 14*a* of the bottom shelf 14**.

Figure 2:
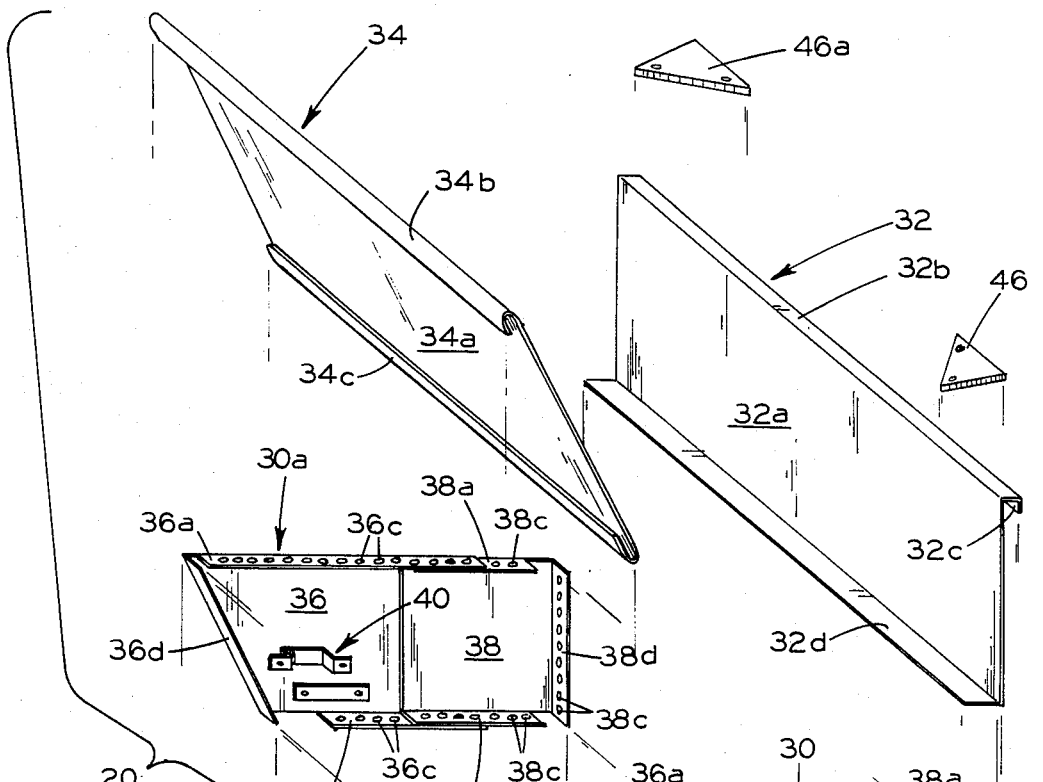
FIG. 2 is an exploded perspective view of the canopy illustrated in FIG. 1, showing the mounting strip in its overlapping position.
Figure 3:
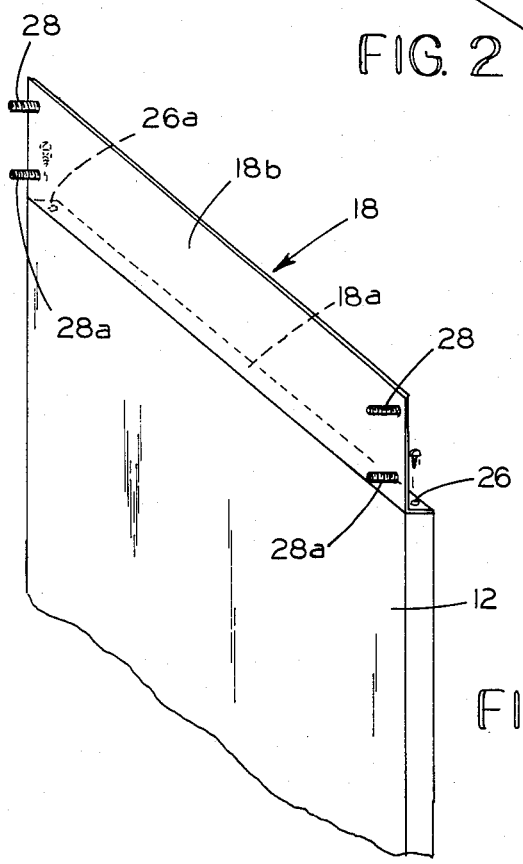
FIG. 3 is a fragmentary perspective view showing the mounting strip projecting above the top marginal edge.

Referring particularly to FIGS. 2 and 3, the universal mounting means 18 consists of a sheet metal strip generally L-shaped in cross-section having two flange portions **18*a* and 18*b* extended perpendicularly to each other; one flange portion 18*a* in which at least a pair of spaced apertures 26 and 26*a* for attachment to the top marginal edge of the back panel 12 and the other flange portion 18*b* having two pair of spaced threaded stud fasteners 28 and 28*a* projecting outwardly therefrom in a direction opposite the transverse cross-section of the one flange 18*a* so that the flange 18*b* may overlap the front face of the back panel 12. The stud fasteners 28 and 28*a* are fixedly secured to the flange portion 18*b* as by tack welds (not shown). The flange portion 18*a* may be secured to the top marginal edge of the back panel 12** by sheet metal screws (not shown) or double face tape.

It will be noted in FIG. 2 that the flange **18*a* is set on the top marginal edge of the back panel 12 so that the flange 18*b* overlaps the surface 12*a* of the back panel 12. In FIG. 3, it will be noted that the flange 18*a* is set on the top marginal edge of the back panel 12 so that the flange 18*b* of the mounting means 18 projects upwardly from the top marginal edge of the back panel 12 thus providing more usable surface area of the back panel 12**.

Briefly, the header assemblage 20 includes right- and left-hand end panels 30 and **30*a*, respectively, which are mirror images of each other, a rear cover panel 32 and a front cover panel 34** all are interconnected to form a ring-like structure.

More particularly, each end panel 30 and **30*a* comprises a front flange section 36 and a rear telescoping flange section 38. The front section 36 includes upper and lower inwardly facing parallel flanges 36a and 36b, each being provided with a row of apertures 36c. Preferably, the outer front front edge of the front panel 36 is downwardly inclined and provided with an inwardly flange 36d. It will be noted that the lower flange 36b of the front section 36 is spaced from the flange 36d for receiving the post 24 or 24a. The post 24 or 24a is secured to the inside surface of the front section 36 by a flange clamping bracket 40 which may be secured to the front section as by tack welding. The clamping bracket 40 generally comprises a U-shaped bracket 40a having flanged ends 40b and includes a strap 42** which may be secured thereto as by wing nuts (not shown).

The telescoping rear section 38 is provided with upper and lower inwardly facing flanges 38a and and 38b with each flange being provided with a row of apertures 38c aligned with the apertures 36c of the flanges 36a and 36b of the front section 36. The vertically extending rear edge of the rear section 38 is provided with an inwardly facing flange 38d also having a row of apertures 38c, the purpose of which will be described hereinafter. The upper and lower flanges of the front and rear sections 36 and 38 of each end panel 30 and 30a are secured together in a desired depth relationship by conventional machine bolts (not shown). It will be noted that the lower flanges 38b of each rear section 38 is spaced from the flange 38d for receiving the rear mounting stud 22 and 22a extending upwardly from the back panel 12.

The rear cover panel 32 generally comprises an elongate panel 32a formed of sheet metal or the like, having an outwardly extending upper flange 32b provided with a depending lip 32c and a lower inwardly facing flange 32d. The upper flange 32b and its lip 32c are adapted to hang on the top marginal edges of the flange 38d of the rear sections 38.

The front cover panel 34, also formed of sheet metal or the like, generally comprises a center pane 34a having an upper, downwardly folded lip 34b and a lower, upwardly folded lip 34c for receiving display ads. Each open end of the lips 34b and 34c is adapted to engage the top and bottom portions of the flanges 36d of the front panels 36 of the end panels 30 and 30a.

The studs 22 and 22a each is an elongated member, angle shaped in cross section, wherein one flange 22b is provided with a row of apertures 22c, the apertures 22c being aligned with the apertures 38c in the flanges 38d of the rear panels 38 of the end panels 30 and 30a and with the studs 28a and 28b projecting from the mounting strip 18.

The bottom end of each front post 24 and 24a is provided with a pair of depending pins 24b, as illustrated in FIG. 1, which extend into cooperating apertures 14b provided in the top surface 14a of the shelf 14.

Figure 4:
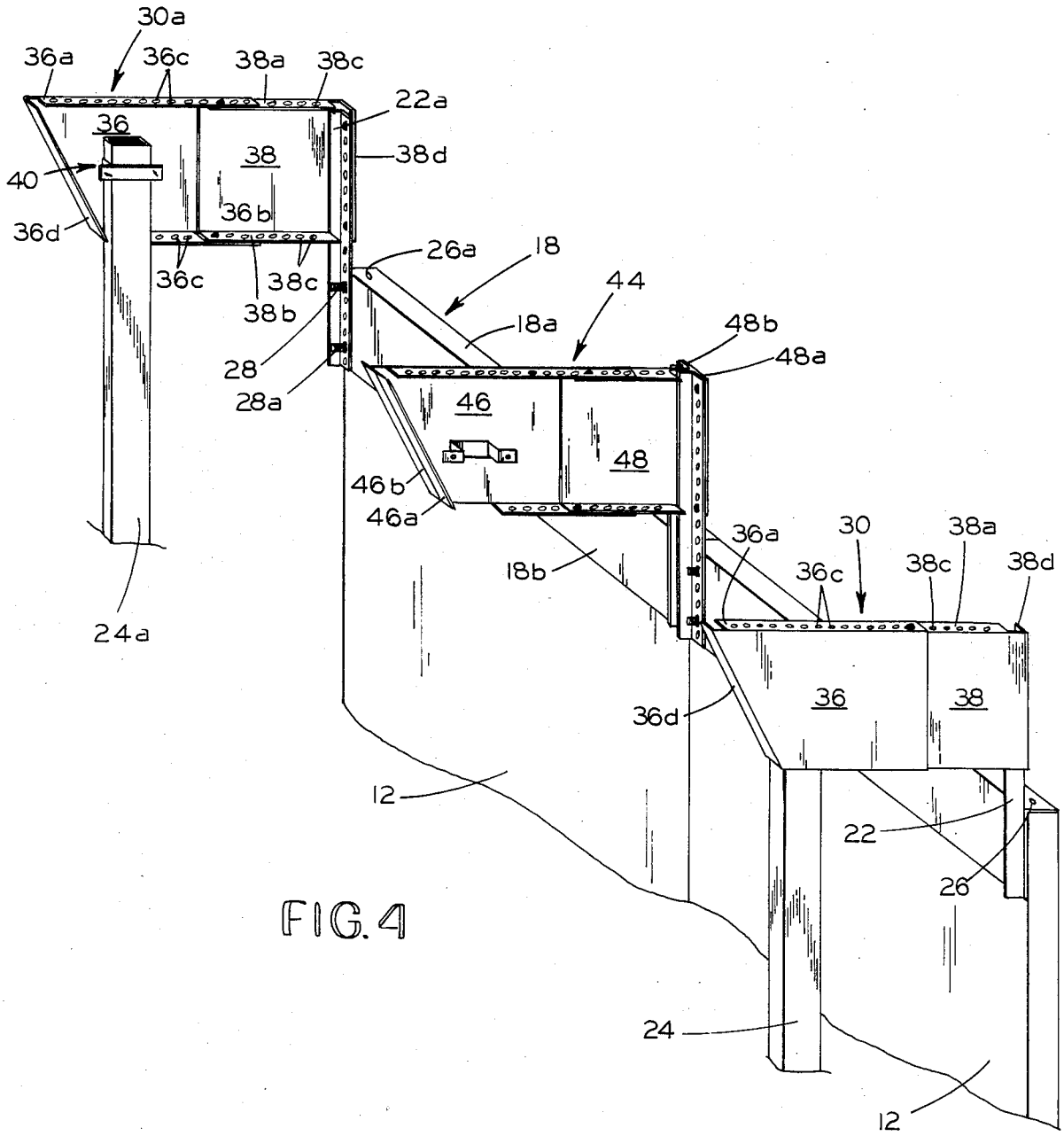
FIG. 4 is a fragmentary perspective view of another embodiment of the canopy installed on multiple gondola units.
Figure 5:
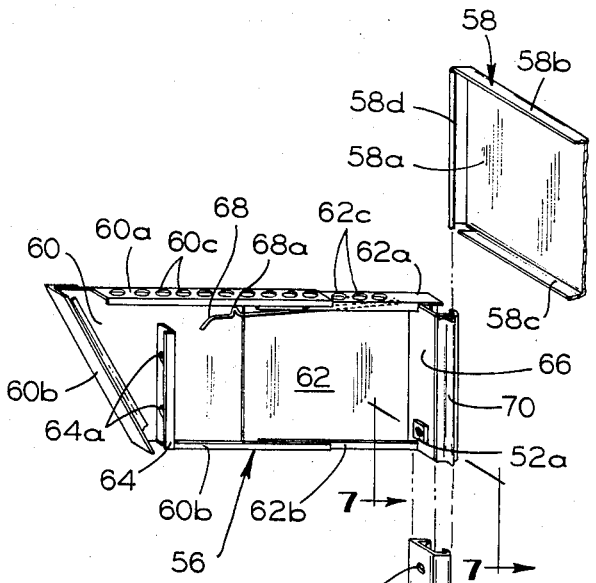
FIG. 5 is a fragmentary exploded perspective view of another embodiment of a canopy constructed in accordance with the invention.

In assembling the canopy 16 on the gondola 10, the mounting means 18 or 18' is preferably placed on the top marginal edge of the panel 12 as illustrated in FIGS. 2 and 5, and secured thereto at each end by sheet metal screws (not shown) or by double face tape. If multiple units, as illustrated in FIG. 4, are employed, then the mounting means 18 or 18' are butted end-to-end when installed on the top marginal edge of the back panels. In this case one or more center panels 44 is employed. The center panel 44 includes a flange front section 46 and a rear flange section 48. These sections 46 and 48 are substantially similar to the corresponding end panel sections 32 and 34, except that vertically extending flanges extend from each side of the panels. More specifically, the front edge of the section 46 is provided with oppositely extending flanges 46a and 46b. Likewise, vertically extending flanges 48a and 48b extend from opposite sides of the rear edge of the section 48. Otherwise, the center panel 44 includes the same structural elements as previously described for the end panels 30 and 30a.

Each end of the flange portion 18b' of the L-shaped mounting means 18' includes an outwardly flanged channel member 50 which is attached, as by tack welding, to the front face of the flange portion 18b' in an upstanding position to extend above the flange portion 18a. The portion of the channel members 50 extending above the mounting means flange 18a' is provided with a weld nut 52 and bolt 54, the purpose of which will be described hereinafter. The mounting means 18' may be attached to the back panel 12 as previously described.

The header assemblage 20', in this embodiment of the invention, includes right- and left-hand end panels 56 and 56a (not shown), respectively, which are near images of each other, a rear cover panel 58 and a front cover panel (not shown) substantially the same as the previously described front cover panel 34.

More particularly, each end panel 56 and 56a comprises a front flange section 60 and a rear telescoping flange section 62. The front section 60 includes upper and lower inwardly facing parallel lip tight flanges 60a and 60b, respectively, the upper flange 60a being provided with a row of apertures 60c. Preferably, the outer front edge of the front panel 60 is downwardly inclined and provided with an inwardly facing flange 60d. It will be noted that the lower flange 60b of the front section 60 is spaced from the flange 60d for receiving the post 24 or 24a. The post 24 or 24a is secured to the inside surface of the front section 60 by an upright flange strip bracket 64 which may be secured to the front section 60 as by tack welding. The strip bracket 64 includes at least two longitudinally spaced locking tabs 64a formed to project over the opening provided in the lower flange 60b for cooperating with complementary opening provided in the side of the adjacent post 24 or 24a.

The telescoping rear section 62 is provided with complementary upper and lower inwardly facing lip tight flanges 62a and 62b, with the upper flange 62a being provided with a row of apertures 62c aligned with the apertures 60c of the flange 60a of the front section 60. The vertically extending rear edge of the rear section 62 is provided with an inwardly facing flange channel member 66 (see FIG. 7), the purpose of which will be described hereinafter. A spring loaded lever 68, one end of which has a locking tab 68a that is adapted to project into aligned apertures of the complementary upper flanges 60a and 62a has its other end affixed as by tack welding to the flange 62a. The lever 68 locks the front and rear sections 60 and 62 in a desired depth relation.

The rear cover panel 58 generally comprises an elongate panel 58a formed of sheet metal or the like, having an inwardly extending upper flange 58b and a lower inwardly facing flange 58c. The vertically extending edge of the panel 58a is provided with a rolled flange 58d for cooperating with a complementary flange member 70 affixed to the side of the channel member 66. The lower flange 58c is spaced from the rolled flange 58d while the upper flange 58b overlaps the rolled flange 58d, thus permitting the rear cover panel 58 to be connected to the rear panel section 62 of the end panel 56.

Figure 6:
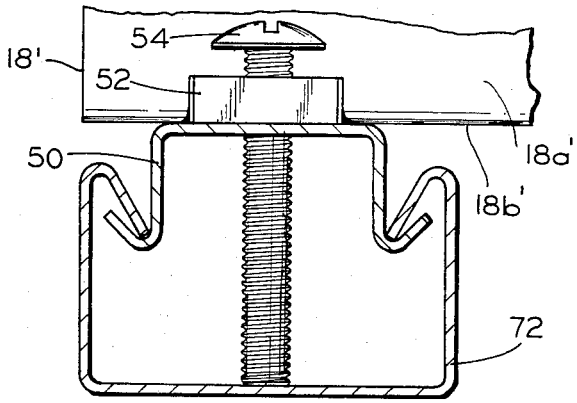
FIG. 6 is a fragmentary cross-sectional view taken substantially along line 6—6 of FIG. 5.
Figure 7:
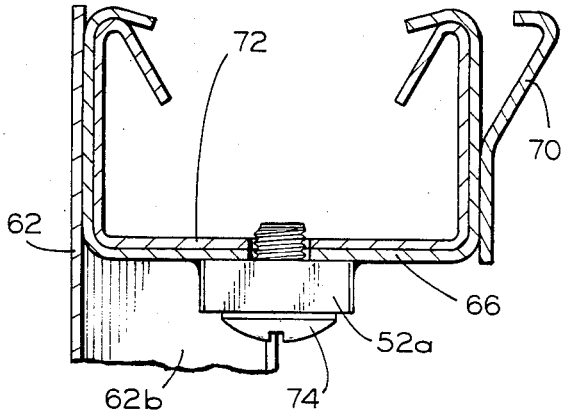
FIG. 7 is a fragmentary cross-sectional view taken substantially along line 7—7 of FIG. 5.

An inwardly flanged channel member 72 whose flanges are complementary to and cooperate with the flanges of the channel members 50 and 66 (see FIGS. 6 and 7) supports and connects the header assemblage 20' to the mounting means 18'. Referring to FIGS. 6 and 7, a weld nut 52*a* is affixed to the outer face of the channel member 66 and cooperates with an opening 72*a* provided in one end of the channel member 72 for receiving a bolt 74 for securing the members 66 and 72 to each other.

In all other aspects, the members employed in this embodiment of the invention are the same as those employed in the previously described embodiment.

When the header assemblage 20 is used, the rear studs 22 and 22*a* are attached to the studs 28 and 28*a* by nuts (not shown). It should be noted that the header assemblage 20 may be mounted directly on the mounting means 18 without the studs 22 and 22*a* that is, if the back panel 12 of the gondola 10 is of an appropriate height. The end panels 30 and 30*a* and the center panel or panels 44 are then attached to the studs 22 and 22*a* by machine nuts and bolts (not shown) extending through the apertures 38*c* aligned with the aperture 22*c* of the studs extending inside the flange portions 38*d*, 48*a* and 48*b*. As previously mentioned, the flange portions 38*d*, 48*a* and 48*b* may be attached directly to the mounting strips 28 and 28*a*.

When the header assemblage 20' is used, one end of the channel member 72 is telescoped over the channel member 50 as illustrated in FIG. 6 and the bolt 54 is rotated in a direction to clamp the flanges thereof against the complementary flanges of the channel member 50. The other end of the channel member 72 is telescoped within the channel member 66 of the rear panel section 62 of the end panel 56 and may be secured thereto by the bolt 74 being rotated in a direction to force the complementary flanges thereof against the complementary flanges of the channel member 66. On the other hand, bolt 74 can be inserted through an aperture provided in the channel member 72 to cooperate with the weld nut 52*a* provided on the channel member 66 to securely fasten the channel member 72 to the channel member 66.

The posts 24 and 24*a* are then either assembled in the clamp 40 as illustrated in FIG. 2, by wing bolts (not shown) or to the locking tabs 64*a* illustrated in FIG. 5, with the pins 24*b* of the posts inserted into the apertures 14*b* of the shelf 14.

In the embodiment shown in FIG. 2, the back panel 32 is assembled by hooking the flange 32*b* over the top edges of the flanges 38*d* and/or the flanges 48*a* and 48*b* of the end panels 30, 30*a* and/or 44. Corner braces 46 and 46*a* (see FIG. 2) may be secured to the top, marginal corner edges of the end panels 30, 30*a* and the adjacent portion of the flanges 32*b* for rigidly strengthening the canopy assembly. In the embodiment of the invention shown in FIG. 5, the rear cover panel 58 is assembled to the end panel 56 by sliding the flange portion 58*d* over the complementary flange of the member 70 until the upper flange 58*b* rests on the top marginal edge of the member 70.

The front side panel 34 is then assembled by sliding the open end of the lips 34*b* and 34*c* over the adjacent end portions of the flanges 36*d*. The header 20 is then adjusted so that all panels are level and the wing nuts are tightened. Desired ads are then installed in the front panel.

If desired, appropriate lighting fixtures may be mounted within the header assemblages 20 and 20' for illuminating and causing attention to be focused on the displayed products.

It will be appreciated from the foregoing description that the invention has resulted in a canopy for enhancing product displays which is comprised of a minimum number of components when the components can be installed quickly, economically and without the requirements of any particular expertise or tools or fasteners. Also, the canopy is one which can be easily removed and installed on other gondolas with the same ease as the initial installation.

In accordance with the patent statutes, the principle and mode of operation of the invention has been explained and what is considered to represent its preferred embodiment has been illustrated and described. It should, however, be understood that the invention may be practiced otherwise than as specifically illustrated and described without departing from its spirit and scope.

What is claimed is:

1. A canopy for installation on a product display gondola having a bottom shelf and a back panel extending vertically upward from the rear side of the bottom shelf, said canopy comprising:

(a) an elongate L-shaped section mounting means including two flange portions extending perpendicularly to each other attached to the top horizontally extending marginal edge of the back panel and having one flange portion extending along the length of the top marginal edge of the back panel fixedly attached thereto;

(b) a header assembly disposed above the display gondola and comprising a rear panel, a front panel, and two end panels which are interconnected to form a ring-like structure;

(c) means for attaching the rear edges of said end panels to the other flange portion of said L-shaped section mounting means; and (d) means for supporting the opposite ends of said end panels from the bottom shelf of the display gondola.

2. The invention defined in claim 1 wherein said L-shaped section mounting means commprises at least one stud bolt extending outwardly from each end of said other flange portion in a direction opposite to said one flange portion for attaching the rear edges of said end panels to said L-shaped section mounting means whereby said L-shaped section mounting means may be mounted on the top marginal edge of the display gondola with its other flange portion depending downwardly to overlap the back panel.

3. The invention defined in claim 2 wherein said means for attaching the rear edge of said end panels comprises a vertically extending stud fastened on each said stud bolt of said mounting means and each said end panel includes an apertured flange for attachment to said vertically extending stud.

4. The invention defined in claim 3 wherein each said stud includes an aligned row of apertures for positioning said header means at different heights above the display gondola.

5. The invention defined in claim 3 wherein each said end panel comprises front and rear telescoping flange sections and includes means for locking said telescoping sections in desired positions relative to each other.

6. The invention defined in claim 5 wherein said front section of said end panel includes clamping means spaced from said stud and including a post depending from said clamping means and extending to the bottom shelf of the display gondola.

7. The invention defined in claim 6 wherein the bottom end of said post depending from said clamping means includes at least one depending pin which projects into an aperture provided in the bottom shelf of the display gondola.

8. The invention defined in claim 1 wherein said L-shaped section mounting means comprises an elongate member extending the length of the top marginal edge of the back panel having said other flange portion depending downwardly to overlap the back panel, and including an outwardly flanged channel member affixed to each end of said other flange portion to extend above said one flange portion.

9. The invention defined in claim 8 wherein each said end panel comprises front and rear telescoping flange sections and includes means for locking said telescoping sections in desired positions relative to each other.

10. The invention defined in claim 9 wherein the rear edge of said rear flange sections comprises a channel member, and said means for attaching the rear edge of said end panels to said other flange portion comprises an elongate complementary channel member having inwardly directed flanges, said complementary channel member having an end telescoped within the channel section of said rear flange section with the inwardly extending flanges at the other end telescoped over the outwardly extending flanges of said channel member affixed to said L-shaped section mounting means, and means for securing the ends of said channel member to the respective telescope members.

* * * * *